United States Patent [19]
Arioli et al.
[11] 4,186,572
[45] Feb. 5, 1980

[54] STEAMING APPARATUS FOR PRINTED FABRICS

[76] Inventors: Amedea Arioli; Lorenza Arioli, both of via Colombo 20, 21040 Gerenzano (Varese), Italy

[21] Appl. No.: 947,577

[22] Filed: Oct. 2, 1978

[30] Foreign Application Priority Data

Oct. 6, 1977 [IT] Italy ..... 28335 A/77

[51] Int. Cl.[2] ..... D06B 3/10; D06B 3/30; D06B 23/00

[52] U.S. Cl. ..... 68/5 C

[58] Field of Search ..... 68/5 C, 5 D, 5 E; 223/51; 34/50

[56] References Cited

U.S. PATENT DOCUMENTS

| | | | |
|---|---|---|---|
| 1,913,615 | 6/1933 | Rupp | 8/149.3 |
| 3,257,739 | 6/1966 | Wentz | 34/50 X |
| 3,732,628 | 5/1973 | Blevens et al. | 68/5 C X |
| 3,967,473 | 7/1976 | Arioli et al. | 68/5 D |

FOREIGN PATENT DOCUMENTS

| | | | |
|---|---|---|---|
| 1129445 | 5/1962 | Fed. Rep. of Germany | 68/5 D |

*Primary Examiner*—Philip R. Coe
*Attorney, Agent, or Firm*—Bucknam and Archer

[57] ABSTRACT

An apparatus for steaming printed fabrics is described which comprises a treating chamber, humidifying passages or channels in the chamber, through which the steam present in the chamber is caused to circulate. The apparatus comprises means for supplying additional humidity by introduction of water into the steam circulating through the channels, and means effective to cause the supplied water, if not vaporized, to collect in the channels so that water in liquid state is prevented from entering the treating and steaming chamber. The humidifying channels are essentially U-shaped and comprise a downwardly directed inlet portion, a passage direction reversing intermediate portion and an upwardly directed outlet portion. Nozzles are provided in the downwardly directed portion as to establish in this latter a dynamic steam entraining effect from the environment. The apparatus is advantageous to obtain the greatest color yield of the dyestuff material present in the fabric.

10 Claims, 6 Drawing Figures

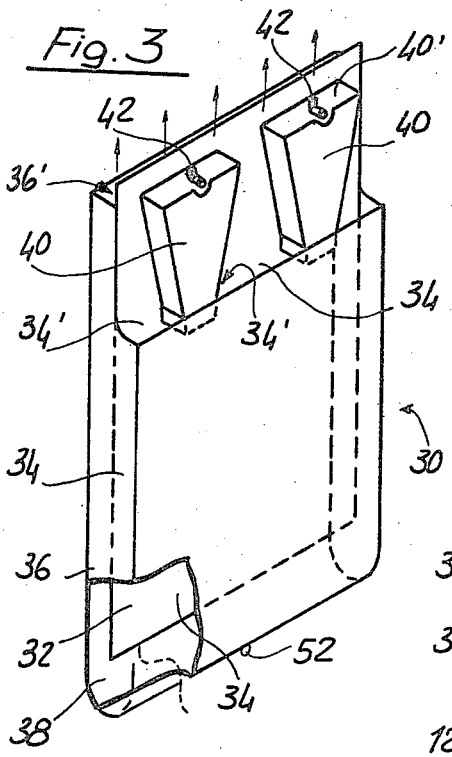
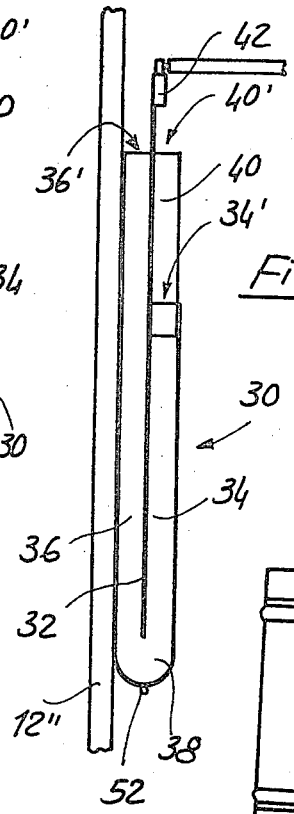
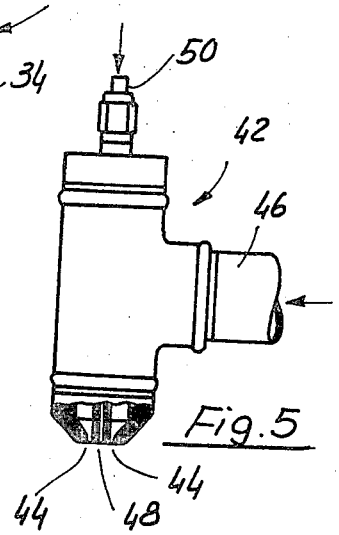
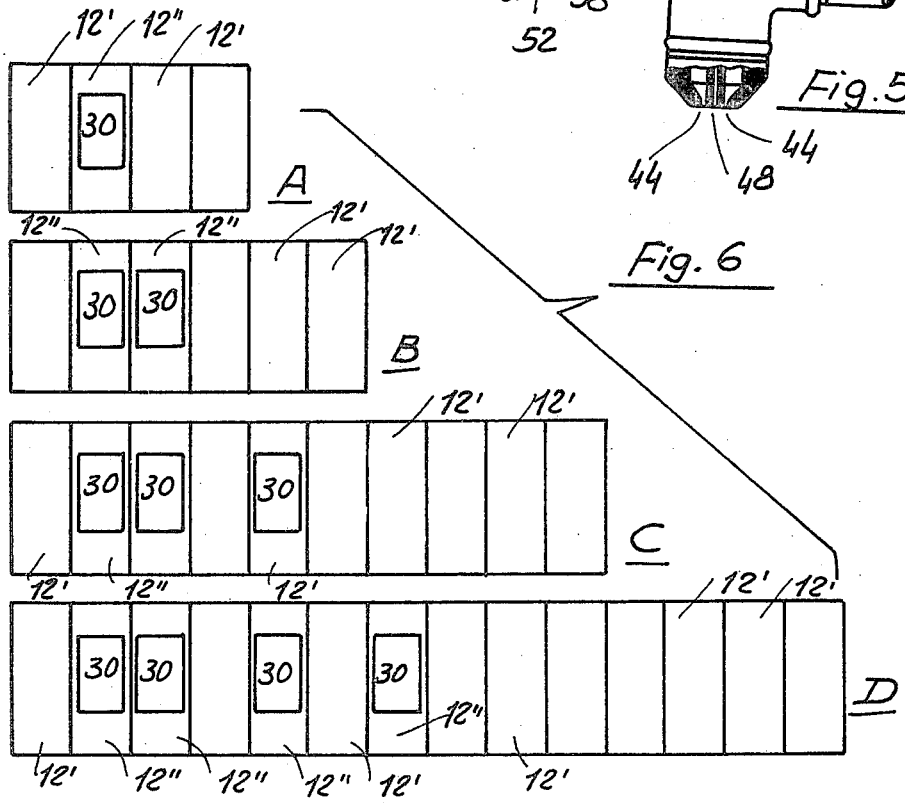
Fig. 6

STEAMING APPARATUS FOR PRINTED FABRICS

The present invention relates to an improved apparatus for carrying out, in a continuous way, the so-called steaming treatments of fabrics, specifically of printed fabrics, and of pad dyed fabrics and dried in order to obtain the development and/or the setting of the dyestuff preliminarly applied during the printing step onto said fabrics.

These treatments are generally carried out by advancing the printed fabric, in a continuous way, without tension and in a "free lap" condition through an environment occupied by steam and, as far as possible, in the absence of air. Machines and apparatuses of this type are known in the art and have been described for example in the Italian Pat. No. 762,357 and No. 843,234, said apparatuses comprising essentially a treating chamber, closed front, side and upper walls thereof, the printed fabric being introduced through and extracted from the bottom of said treating chamber. The steam is introduced through the top towards the bottom, through openings located at an uppermost point of the space enclosed by said walls, thereby said steam is caused to progressively descend in said space, expelling therefrom, nearly completely, the initially present atmospheric air, in such a way that the fabric lap being treated is advanced and maintained under an atmosphere practically consisting of steam.

According to further subsequent improvements carried out by the Applicants, the treating chamber comprises side and upper walls having double wall portions andtherebetween an interior passage provided, at the top thereof, with the openings for introducing the steam into the chamber. At the base or bottom of said passage are located means for heat exchange means effective to generate saturated steam, and in said passage are located other means for heat exchange means, in particular consisting of coils through which a thermal carrier (such as diathermal oil, superheated water or steam) passes effective to bring and maintain said steam to/at the thermal and hygrometric conditions necessary for the treating. These improved apparatuses have been described and illustrated in the Italian Pat. No. 984,050 (Application No. 23294 A/73) corresponding to British Pat. No. 1,459,326 and the U.S. Pat. No. 3,967,473, respectively. Reference to this United States patent is herein made for a more complete understanding of the background and objects of the present invention.

The improved apparatus according to the present invention is essentially based on the ascertainment and the application of certain technical and hygrometric conditions, in such a manner as to more rationally exploit the fact that many dyestuffs used in the textile industry (in particular according to the most recent developments) are able to fix or set onto the fabrics after a certain period of time of residence in a saturated steam environment, the dyestuff setting rate, or more precisely the colour "yield" of said dyestuffs being a function of the saturation rate of the steam contained in the treating environment. The known apparatuses, as described in the hereinabove indicated patents, were generally provided with the required properties, without producing drippings which would have negatively affected the printed fabric quality.

However, it has been found that, in addition to the high costs resulting from the continuous delivery of thermal energy, due to the practically continuous and great delivery of steam, this saturation condition was subjected to alterations, in particular during the treating of some types of fabrics which, by absorbing water, caused a progressive loss of the environment humidity as far as to produce a decrease of the colour yield. This drawback may be compensated for and re-equilibrated, only within certain limits, by means of an increase of the hygroscopic auxiliary components in the compositions of the used printing pastes.

In the light of the above description, it is an object of the present invention to provide an apparatus of the hereinabove indicated type and for the hereinabove indicated industrial applications, improved in such a way as to allow for the introduction in the environment of new or additional humidity or moisture, thereby adding to or integrating the humidity absorbed by the fabric which has already passed and/or is advancing through said environment. In this manner the fabric being introduced into the steaming environment may find in the environment the most convenient saturation rate to assure the colour yield of the dyestuffs applied onto the printed fabric itself. Further the technical solutions adopted for carrying out the improvement according to the present invention is such as to prevent drippings from occurring and allowing for an automatic metering of the additional applied moisture.

It it is also well known that the parameter defining the relative humidity rate of the environment saturating steam is the temperature. In fact this rate is defined by the ratio of the environment pressure and the relative saturation pressure, at the actually measured temperature.

On the other hand, the pressure in an environment opened at the bottom thereof (such as that of the considered apparatuses) has to be equal to the atmospheric pressure. Therefore, at this pressure, (about 0.07 lb./sq.in) a 100% rate of relative humidity is obtained for a theoretical temperature of the order of 99° C. and it progressively decreases, according to a well known function, as the temperature increases, and, for example, the relative humidity is lowered to a 66.6% rate at the temperature of 110.79° C. at ambient pressure. At this temperature, the saturation pressure (sP) is of 0.10 lb./sq.in and therefore the ratio of the ambient pressure (aP) and the saturation pressure, at the temperature of 110.79° C. is $aP/sP=0.66$.

Therefore, it is apparent that in order to assure a maximum humidity condition, it is necessary to maintain the temperature within advantageously low values and within the limits effective to prevent the formation of drips.

As it has been observed previously it is known that the colour yield, during the colour setting process, is strictly dependent on the humidity rate of the fabric to be treated. It is also known that a dry fabric, when it is located in a humid environment, re-absorbs by itself humidity as it reaches its own natural equilibrium point, this latter being a function of the temperature and relative humidity. It is furthermore apparent that the transformation of the water into steam requires an energy expenditure (and consequent processing costs), whereas the inverse transformation (such as that which occurs during the humidifying or moistening of the fabric) causes thermal energy to be given up.

Therefore, in the operation of an apparatus for the steaming (i.e. the moistening) of printed fabrics during the applied dyestuff treating step, several phenomena occur which on the one hand change depending on the progressive advancement of said fabrics through the treating chamber or environment, as the fabric, entering said environment in a practically dry condition, acquires humidity or moisture, which may however be reduced reduce on a continued advancing, due to the continuously applied heat.

In the light of the above description, it is an object of the present invention to provide an apparatus of the indicated type and uses, which is further improved in such a way as to account for the thereinabove indicated and other phenomena, to allow for the colour setting process to continue under the most favourable conditions with respect to the colour yield, for the main portion of the residence period of time of the fabric in the saturated steam environment, without being negatively affected by any drippings. In other words, the improved apparatus according to the present invention is effective to assure the obtaining of the greatest production yield both quantitatively and qualitatively.

Another object of the present invention is to provide an improved apparatus exploiting the thermal exchanges occurring in said environment, in order to increase the economical yield of said system, from the point of view of the thermal energy which has to be supplied from the exterior.

It is another object of the presenti invention to provide an improved apparatus in which the occurrence of these conditions is assured with an even distribution of the humidity or moisture on the overall surface of the fabric passing in and through the treating ambient.

Yet another object of the present invention is to provide an improved apparatus in which the technical and operating means which are present in the treating environment do not include moving component parts (such as fans, pumps and the like) and are able to selectively operate only in the zone or zones in which the increasing of the humidity contents is desiderable and advantageous.

The aforesaid and other objects and advantages of the present invention are mainly achieved in that to an apparatus essentially as thereinabove illustrated and essentially as described in the aforesaid Italian Pat. No. 984,050 (and the corresponding U.K. Pat. No. 1,459,326 and U.S. Pat. No. 3,967,473) of the same Applicant are associated humidifying or moistening passages or "channels" having inlets and outlets in the interior of said treating chamber, under particular conditions defined hereinbelow, and associated to water essentially as a spray and pressurized steam ejecting means (supplying the energy for driving gaseous streams in said channels) thereby circulating the gaseous mixture present in the environment, while supplying and distributing in said environment the necessary additional humidity.

The aforesaid and other more specific characteristics of the present invention will become more evident from the following detailed description of a non limitative example of an improved apparatus embodiment illustrated, only with respect to the parts pertaining to the present invention, (for the structure and other component parts, means and devices, reference should be made to the known art and in particular to the aforesaid patents) in the accompanying drawings where:

FIG. 3 illustrates in perspective in greater detail, a structure of a "module" including humidifying or moistening channels, a portion of said structure being sectioned;

FIG. 4 is a vertical cross-section taken through the symmetry plane of the structure illustrated in FIG. 3;

FIG. 5 illustrates in greater detail a non exclusive exemplificative embodiment of one of the ejecting means effective to eject a jet having the double function of driving means effective to assure the environment circulation and for supplying water as a spray to the evaporated, while absorbing it, from the environment to selectively supply the additional humidity;

FIG. 6 is a diagram illustrating, as an example, in the parts thereof indicated by A–D, several possible distributions of modular components, and non modular components acccording to FIG. 3, effective to be used for structurally and operatively forming the treating environment, in apparatuses of different capacities and/or effective to operate under different service conditions.

Figure 1:
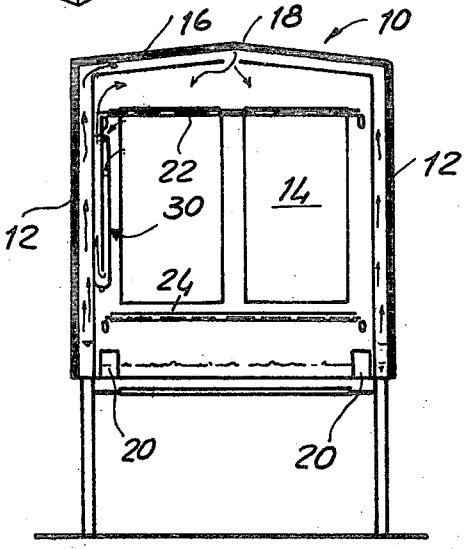
FIG. 1 is a cross-section taken through a vertical plane, on small scale and in an essentially schematic form, of the structure of the treating environment which is a characteristic of the present invention.
Figure 2:
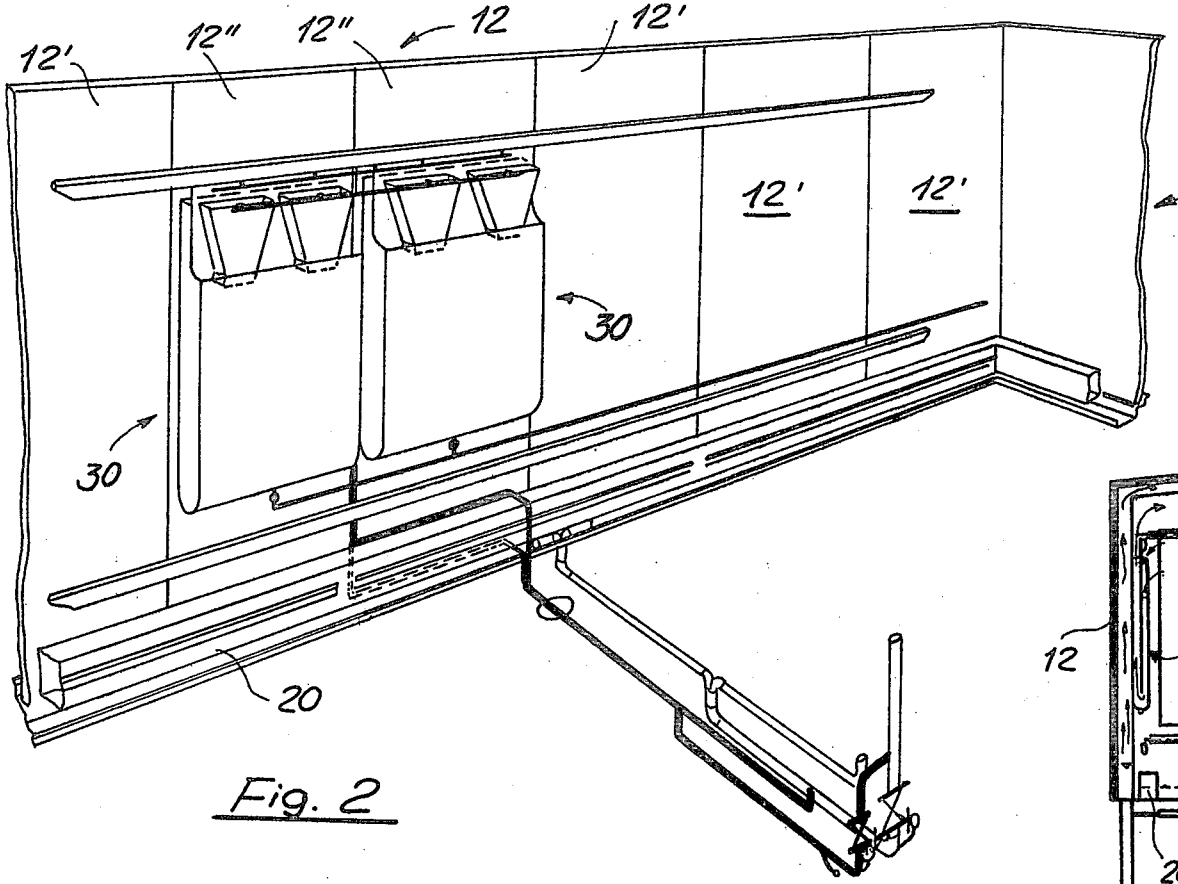
FIG. 2 is a perspective fragmentary view of the interior of one of the walls of said chamber.

Generally, as it is illustrated in FIG. 1, an improved apparatus according to the present invention comprises a treating environment formed in a structural assembly 10 having side, front, and upper walls indicated respectively by 12, 14 and 16 and illustrated in detail in FIG. 2. These walls are insulated on the exterior thereof, in order to reduce to a minimum the losses of heat to the exterior, and comprise gaps or spaces at the bases or bottoms of which is produced saturated steam (as described in the aforesaid patents) and include, at the top of the treating environment, openings or ports 18 for introducing from the top said steam which, also according to the known art, progressively moves downwardly expelling the atmospheric air as far as to reach, by stratification, the lowermost levels of the environment, which is open at the bottom thereof. At these levels are located said passages or boxes 20 provided with inwardly directed openings. Descending steam is sucked into these boxes due to recovery and energy balance increasing reasons.

In the interior of the treating chamber, for the detail and basic operation of which reference should be made to the aforesaid patents of the same Applicant, are located means for orderly supporting the flaps and for progressively advancing the fabric to be treated, all along the length of the treating environment, said means being generally formed by upper and lower transversal rods or "sticks" 22 and 24 respectively, supported by and advancing along suitable rails located at the side portions.

The essential characteristic of the present invention consists of the presence and service of forming units or modules in said humidifying channels. The carrying out and modular distribution, or in the form of standardized structural units, of these channels, do not constitute a critical element of the invention, but it is a very advantageous element both from the point of view of the production and the installation thereof, for example on pre-existing apparatuses not provided with said units, and from the point of view of the selective distribution of said units all along the length of the differently sized apparatuses, and in the zones in which the supplying of said additional humidity is desirable and advantageous.

Each said module or unit is generally indicated by 30. In a like way, each module is also advantageously associated to a component element, also advantageously of modular type, of the structure of the side walls 12. In FIGS. 2 and 6, some modular components of the walls 12 are individually indicated by 12' and those thereto are associated modules 30 of humidifying channels are indicated by 12'. FIG. 6 illustrates as an example only the manner in which said humidifying channel modules or units 30 may be installed and distributed, at differently spaced positions, on the length of the apparatus, or at several points of the advancing direction through the treating chamber by the fabric.

As it is illustrated in a more detailed way in FIGS. 3 and 4, each unit 30 is essentially formed by a flattened and vertically elongated box or tank, said box being divided, also vertically through the main plane thereof, by a diaphgram or intermediate wall 32, formed by vertically adjoined parts 34 and 36, both opened at the top and jointly forming an "U" passage at the lower portion 38 of the unit so that the direction of flow is reversed. In the mouth of the front portion 34 (the lower one) is inserted the lower portion of another structure 40 or other structures 40 (preferably two), opened at the top and at the bottom, and forming downwardly converging channels. At the mouth of each said channel, formed by the structure 40, are located injecting-humidifying devices 42, one of which is illustrated in detail in FIG. 5, which are provided, at the bottom thereof, with a nozzle system comprising a plurality of said nozzles 44, supplied by adjustable and relatively low pressure steam (for example from 0.1 to 0.6 Ate) for example through a duct 46, and a central nozzle 48, supplied by water, for example through a duct 50 controlled by a solenoid valve in turn controlled by a thermostat effective to sense the ambient or environment temperature.

The outflow of pressurized steam, consequently provided with high speed, through the nozzles 44, causes a downwardly directed stream in the respective structure 40 and therefore a suction of steam from the environment to the uppermouth 40' of said structure. This downwardly directed stream in said structures 40 causes in turn a suction at the uppermouth 34' of the downwardly directed passage 34, in said spaces of the structures 40. These streams become even by descending through the front portion 34 of the passage, by reversing the flow at the lower portion 38 of the overall U-shaped channel and are introduced again in the treating environment, at the uppermouth 36' of the upwardly directed portion 36 of said channel, under reduced speed and optimal eveness conditions, thereby providing in the treating chamber a circulation free of undesired swirls and localizations. The distribution of several units, as exemplificatively illustrated in FIG. 6, being selectively preselected according to the apparatuses, in particular to the treating chamber length, in addition to a selective actuation of the single units, allows for a rational adapting of the apparatus to the different treating conditions to be obtained.

The water inflow is controlled by and depends on the ambient temperature. As the thermostatic system detects an undesired temperature increase, it causes the solenoid valve to open, with the consequent delivery of water through the duct 50 which water, exiting the nozzle 48, is converted into a spray. A portion of this water, passing through the U-shaped channel 34, 38 and 36 vaporizes thereby taking up heat from the environment steam, and therefore the temperature of said steam will fall to the limit saturation point. The excess water which is not vaporized, drains to the lower portion 38 of the U-shaped channel and is discharged through suitable draining passages 52.

The thermostatic system is so arranged as to admit a rather accurate adjusting, preferably of ±1° C., being assured a maintaining of the environment or ambient temperature at the most suitable values (generally slightly greater than 100° C.) whereas the circulation of the saturated steam, provided by said channels or units, does not involve the forming of drops, since the excess water and the water which is not vaporized can not be conveyed upwardly through the upwardly directed portion 36 of the channel, in which the gaseous stream speed is very low. In this manner the most advantageous vaporizing conditions may be achieved which, as it was thereinabove originally mentioned constitute the main object of the present invention.

It should moreover be pointed out that with respect to the energy yield of the apparatus, the "driving" steam in the system is taken from the steam usually supplied to the machine and therefore no increase of energy is required for operating the humidifying devices.

It should be moreover noted that the system is able to operate, also at high temperatures, as a steam recirculating device (by using the nozzle provided steam only as a driving means, without humidifying water) in order to enhance the thermal exchanges between the quickly moving steam and the fabric, thereby greatly reducing the treating times with a consequent advantage for the production yield of the system.

In addition to this enhancing of the thermal exchange, the improved steam circulation contributes to the eveness of the temperature in the several zones (even selectively predisposed) and at different levels of the machine or apparatus environment. The advantages of the thus improved machine are particularly evident in the case of treatments at high temperatures, of the order of 170°-180° C., for example for synthetic fibre fabrics. The strict eveness of the treatment is particularly interesting in the treatments of dyed cloths, thereby assuring a precise homogeneity of the setting rate and of the resulting tonality of the colour on the finished fabric.

Since the improved apparatus has been described and illustrated only as an indicative and not limitative example, it should be apparent that said apparatus, overall and with respect to the single component elements or devices thereof, may be carried out by adopting equivalent technical solutions, under the thereinabove mentioned different possible service conditions for which said apparatus may be selectively predisposed, without departing from the scope of the present invention.

We claim:

1. An improved apparatus for steaming printed fabrics, in particular for selectively treating or processing printed fabrics in a chamber essentially saturated with steam wherein the chamber is open at the bottom and comprises means for admitting a fabric to be steamed into said chamber and for removing said fabric from said chamber, said chamber comprising a pair of side walls, an upper wall connecting said side walls, said upper wall and said side walls having double walls which define an interior passage therebetween, means for generating steam in said interior passage, a steam inlet at the uppermost point of the chamber for introducing the generated steam into the chamber, humidifying channels in said chamber, wherein the steam present in said chamber is caused to circulate through said humidifying channels, means for detecting the temperature in the chamber, humidifying means in said chamber responsive to a temperature increase above a predetermined value in the chamber for supplying additonal humidity to said chamber, said humidifying means including means for introducing water in the form of a mist into the steam circulating through said humidifying channels, said humidifying channels being essentially U-shaped and comprising a downwardly directed inlet portion, an intermediate portion connected to said downwardly directed inlet portion for reversing the direction of flow and an upwardly directed outlet portion connected to said intermediate portion, nozzles associated with said humidifying channels for supplying pressurized steam to said channels, said nozzles being arranged and oriented in said downwardly directed portion for establishing therein a dynamic steam entraining effect from the chamber to assure the circulation of the steam through said channels, and means for collecting the supplied water, which is not vaporized, in said channels whereby the water is prevented from entering in liquid state said chamber.

2. The apparatus according to claim 1, wherein the means for collecting the water which is not vaporized is the bottom of said intermediate portion, and means provided for removing the collected water from said bottom of the intermediate portion.

3. An apparatus according to claim 1, wherein the means for introducing water comprises water inlet nozzles associated with the pressurized steam nozzles, whereby the kinetic energy of the steam is used to assure the conversion of said water into a mist as it is introduced in said channels.

4. An apparatus according to claim 1, wherein said humidifying channels, in conjunction with the means effective to supply the entraining and circulating pressurized steam and the water for the selective enhancing of the additional humidity, are formed in structural assemblies comprising passages for the inlet of said steam into said chamber, the entrainment and outlet of said steam from said chamber, under progressively equalizing conditions of the steam travel speed through said channels, whereby an even distribution of the outflowing steam, practically without localizations, is obtained.

5. An apparatus according to claim 4, wherein said passages for the circulating steam comprise first passages provided with converging walls, the steam being sucked into said passages from said chamber, and second passages in communication with said first passages, and in turn comprising inlet passages for sucking further amounts of steam from the chamber, due to the entrainment caused by the kinetic energy of the steam outflowing from said first passages, for completing the distribution of the circulating steam.

6. An apparatus according to claim 5, wherein said second passages comprise said intermediate portion connected to said downwardly directed inlet portion and said upwardly directed outlet portion.

7. An apparatus according to claim 6, wherein said humidifying channels and means associated thereto are structural modular units effective to be selectively installed in at least one position at the treating chamber side walls and substantially adjacent thereto.

8. An apparatus according to claim 7, wherein said structural modular units comprise oppositely directed passages jointly forming said U-shaped channels, extending in planes parallel to said side walls and comprising at the inlets thereof at least two complementary structures forming the first passages in which operate the entraining and additional humidifying nozzles.

9. An apparatus according to claim 8, wherein said humidifying channels are selectively associated to some of said side walls, in an arrangement as to essentially distribute the humidifying supply along the length of said chamber in the zones at which the fabric traveling along the length thereof requires said supply of humidity.

10. An apparatus according to claim 9, wherein the inlets of the humidifying channels are located at a level which is lower than that of the respective outlets, and the outlet portion of said channels is essentially adjacent to a side wall of the chamber.

* * * * *